US006548951B1

(12) United States Patent
Piek et al.

(10) Patent No.: US 6,548,951 B1
(45) Date of Patent: Apr. 15, 2003

(54) DEFLECTION UNIT FOR A CATHODE RAY TUBE AND METHOD OF MANUFACTURING A SADDLE-SHAPED DEFLECTION COIL

(75) Inventors: Hans Piek, Eindhoven (NL); Johannes Penninga, Eindhoven (NL); Nicolaas Gerrit Vink, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 204 days.

(21) Appl. No.: 09/715,594

(22) Filed: Nov. 17, 2000

(30) Foreign Application Priority Data

Nov. 17, 1999 (EP) ..... 99203845

(51) Int. Cl.[7] ..... H01J 29/70
(52) U.S. Cl. ..... 313/440; 335/213; 335/299
(58) Field of Search ..... 313/440; 335/210, 335/296, 299, 213; 348/829

(56) References Cited

U.S. PATENT DOCUMENTS 4,937,931 A * 7/1990 Jacob et al. ..... 335/213
5,013,964 A * 5/1991 Vink et al. ..... 313/440
5,506,469 A * 4/1996 Vink et al. ..... 313/440

FOREIGN PATENT DOCUMENTS

EP 0381267 8/1990 ..... H01J/9/236

* cited by examiner

*Primary Examiner*—Ashok Patel
(74) *Attorney, Agent, or Firm*—Aaron Waxler

(57) ABSTRACT

A deflection unit (4) includes a saddle-shaped deflection coil (30). The deflection coil includes at either the front or rear end a concave part having a left and right corner (41, 42) which define a line (43). The concave part is flanked at either side by adjacent portions (38, 39). It holds that: $\alpha > \beta$ where $\alpha$ angle between a line (43) through the two corners (40, 41) of the concave part (40) and inner windings of the concave part (40), and $\beta$ is an angle between said line (43) and the inner windings at the outer side of a corner (41,42).

6 Claims, 4 Drawing Sheets

DEFLECTION UNIT FOR A CATHODE RAY TUBE AND METHOD OF MANUFACTURING A SADDLE-SHAPED DEFLECTION COIL

The invention relates to a deflection unit having at least one saddle-shaped coil having coil portions, and winding windows, the coil portions having a front end portion and a rear end portion, at least one of the end portions having a part which has a concave shape between two corners.

The invention also relates to a method of manufacturing a saddle-shaped deflection coil having a front and a rear end, at least one of the front or end portions having a part which has a concave shape between two corners.

EP 0 381 267-A1 describes a method of manufacturing deflection units having coils with a concave part at either a rear or a front flange. The concave part is provided by winding a connection portion of the coil in a convex shape around two corner pins and two auxiliary pins, subsequently removing the auxiliary pins and. pushing the convex part into a concave part of the same shape. The convex and later concave parts are limited by corners, i.e. the parts in which the windings change direction. The position of said corners is determined by the position of the two corner pins during winding.

Providing a deflection unit with a concave part offers the possibility of modulating the fields generated by -the deflection coils in such a manner that a greater flexibility can be achieved to correct certain errors such as raster and convergence.

Although this method provides satisfactory results in many instances, the known method and deflection unit offer only limited possibilities for modification of the field generated by the deflection unit. The shape of the concave part is limited, as will be explained later. Particularly in view of the fact that the display windows of CRTs become increasingly flatter, with a strong insistence to reduce the depth of CRTs, leading to larger deflection angles, an increased flexibility to achieve corrections in the generated field would be advantageous.

To this end, the deflection unit in accordance with the invention is characterized in that the following relation holds for the part having a concave shape:

$$\alpha>\beta$$

where $\alpha$ is an angle between a line through the two corners of the concave part and inner windings of the concave part, and $\beta$ is an angle between said line and the inner windings at the outer side of a corner.

For the known prior art it holds that $\alpha<\beta$, as will be explained below. This restriction of angles limits the possibilities of modifying the deflection field, severely decreasing the correcting effects that can be achieved by the concave part.

In deflection units in accordance with the invention, the concave parts are more pronounced, offering more possibilities for correction.

The angle $\beta$ is preferably less than 10°, most preferably approximately 0°. The parts of the coils on either side of the corner portions are then almost in one line.

The angle $\alpha$ is preferably more than 20°. At such angles, the concave part is very pronounced, offering a relatively large modulation of the field.

The method in accordance with the invention is characterized in that, during winding at at least one end portion, the coil is wound around four pins to form a convex part, said four winding pins comprising two stationary and two auxiliary pins, whereafter the two auxiliary pins are removed and two additional auxiliary pins are or have been provided within a winding window determined at least by said four winding pins, and the convex part is pushed inwards into the winding window, against the two additional auxiliary pins, forming two portions extending between the two stationary and the two additional auxiliary pins and a concave part between the two additional auxiliary pins, for which concave part the following relation holds:

$$\alpha>\beta$$

Where $\alpha$ is an angle between a line through two corners of the concave part and inner windings of the concave part, and $\beta$ is an angle between said line and the inner windings at an outer side of a corner.

Within the concept of the invention, 'pin' is to be interpreted as any object around which the windings of the coil are wound (for winding pins) or against which a winding is pressed (for the two additional auxiliary pins).

In contrast to the known method and deflection unit, in which the convex and concave parts substantially have the same shape, the convex shape is transformed into at least three parts, two straight parts and one concave part, in a deflection unit and method in accordance with the invention. This removes some of the restrictions on the shape of the concave part as known from the prior art.

These and other aspects of the invention are apparent from and will be elucidated with reference to the embodiments described hereinafter. Similar components in the Figures have identical reference numerals.

Figure 4:
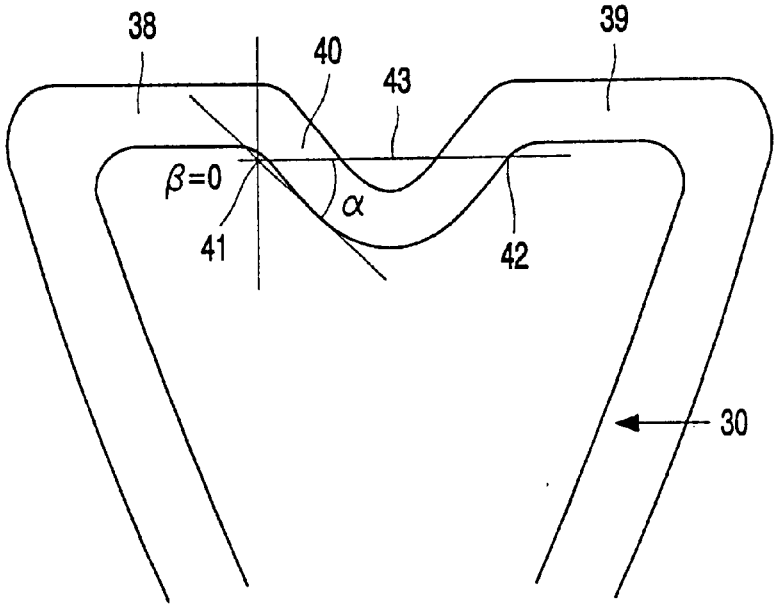
Figure 5:
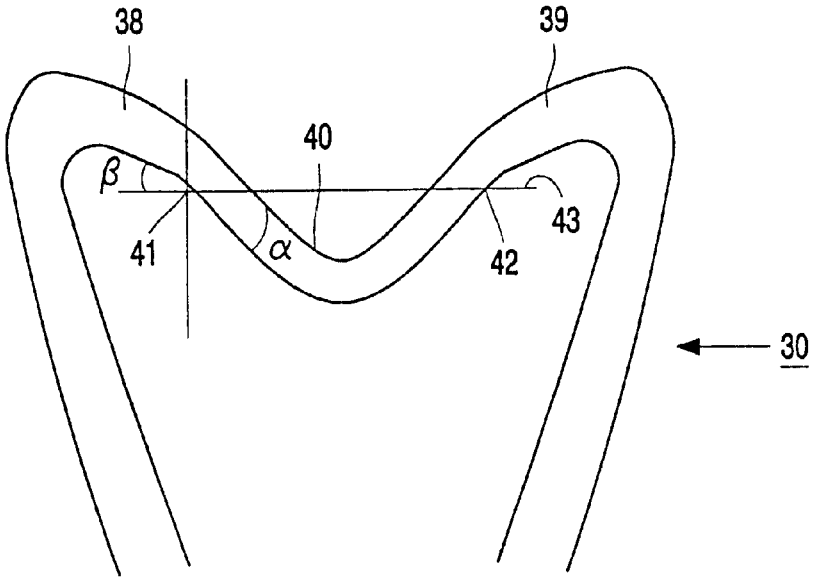

FIGS. 4 and 5 schematically show a part of embodiments of a deflection coil for a deflection unit in accordance with the invention.

The figures are schematic and not drawn to scale and equivalent reference numbers refer to the same or similar elements.

Figure 1:
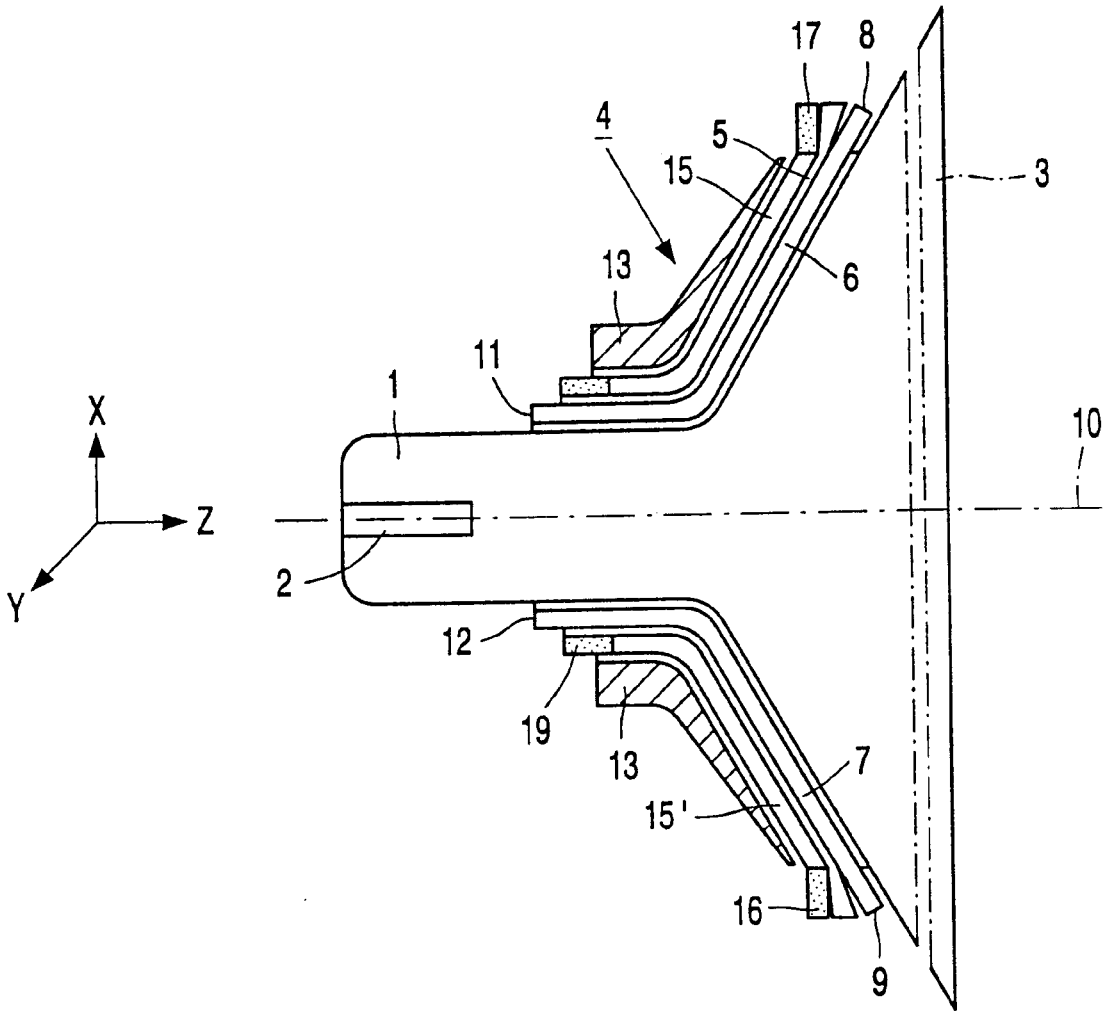
FIG. 1 is a diagrammatic longitudinal section through a part of a picture display tube with a deflection system.

FIG. 1 shows a color cathode ray tube 1 comprising an electron gun system 2 for generating three electron beams which are directed towards a display screen 3 having a repetitive pattern of red, green and blue phosphor elements. An electromagnetic deflection unit 4 is arranged around the path of the electron beams substantially co-axially with the axis of the tube between the electron gun system 2 and the display screen 3. The deflection unit 4 comprises a funnel-shaped coil support 5 which supports line deflection coils 6, 7 at its inner side for deflecting the electron beams generated by the electron gun system 2 in the line direction which is usually the horizontal direction. The flared line deflection coils 6, 7 are of the saddle type and have a front flange 8, 9 at their widest end, which flange is formed by the connection wires between the axial conductor packets and is substantially transverse to the axis 10 of the display tube. At their narrowest end, the coils 6, 7 have packets of connection wires 11, 12 which form the rear end flanges which connect the axial conductor packets of each coil 6, 7 and are laid across the surface of the neck part of the display tube. The flanges could be of the 'lying type' in which the connection wires follow the surface of the tube (lying against the surface of the tube) or of the 'upstanding type' in which the connection wires form a flange 'standing up' from the surface of the tube.

The coil support 5 supports two saddle-shaped field deflection coils 15, 15' at its outer side for deflecting the electron beams generated by the electron gun system 3 in a field direction which is usually the vertical direction. A ferromagnetic annular core 13 surrounds the two coil sets. In the case shown, the line deflection coils are of the type having lying front (8,9) and rear (11,12) flanges, whereas the field deflection coils have an upstanding front (16,17) and a lying rear flange.

Figure 2A:
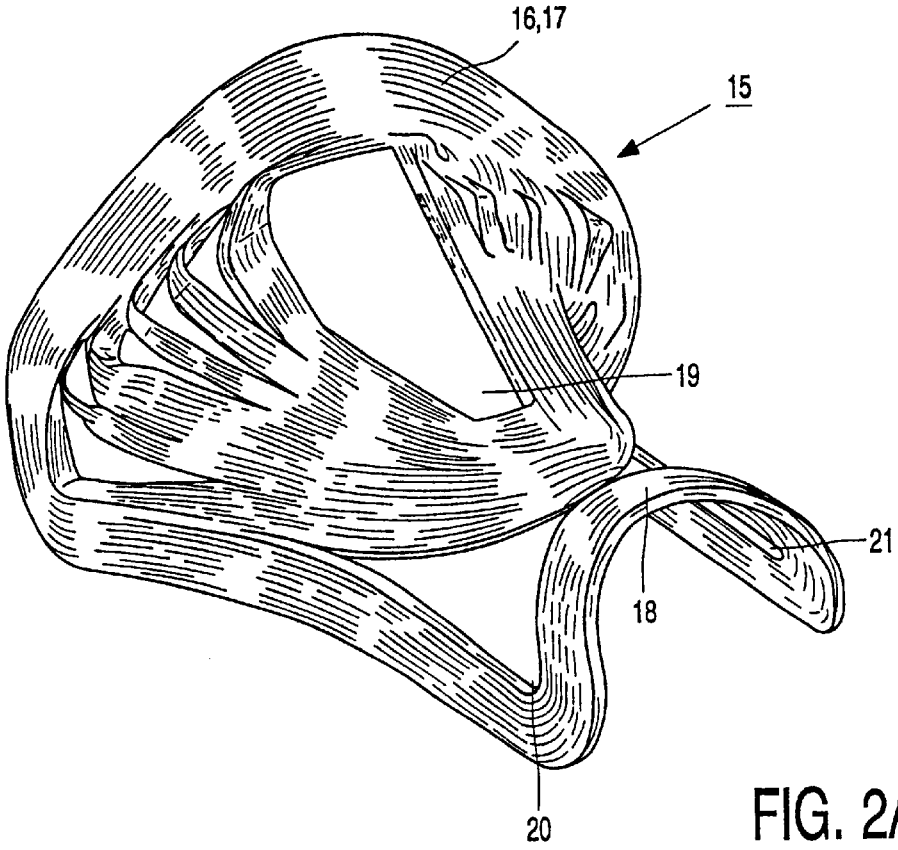
FIGS. 2A to 2C illustrate the known deflection unit and the known manufacturing method.

FIG. 2A shows a deflection coil as known from EP 0 381 267-A1. The lying rear flange is provided with a concave part 18 between corners 20, 21. Also shown is the innermost winding window 19.

Figure 2B:
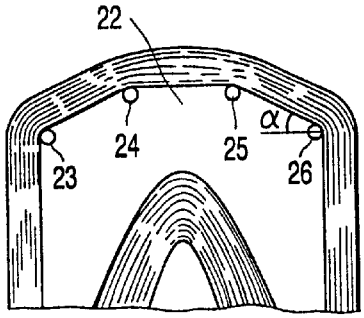
Figure 2C:
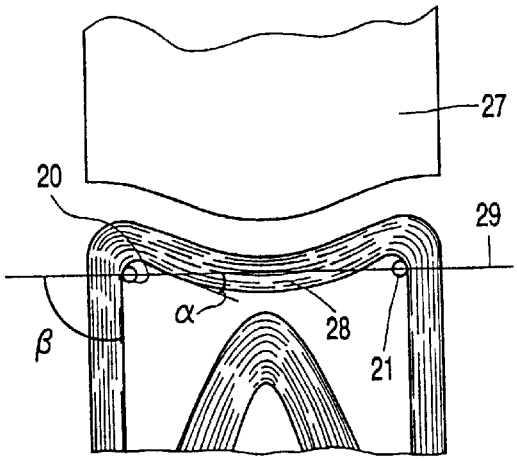

The known method is illustrated in FIG. 2B and 2C. The coil is wound around two corner pins 23, 26 and two auxiliary pins 24, 25, to form a winding window 22. Thereafter, the two auxiliary pins 24, 25 are removed and, using a die 27, the concave part 28 is formed. The corners 20, 21 of the concave part 28 are determined by corner pins 23, 26. A line 29 is drawn through the corners 20, 21. The angles $\alpha$ and $\beta$ between said line 29 and inner windings at the inner side and the outer side, respectively, of the corners 20, 21 are also indicated in this Figure. These angles determine the positions of the coil windings at and near the corners 20, 21 of the concave part 28. It is clear that $\alpha<\beta$, in fact $\alpha<<\beta$. Using the known method, $\alpha$ is always smaller than $\beta$. In fact, the concave shape of part 28 is limited. Since the position and shape of the coil windings determine the direction of the currents, and the direction of the currents determines the electromagnetic fields generated by the deflection unit and thereby the deflection of the electron beams, only limited modifications are possible.

Figure 3A:
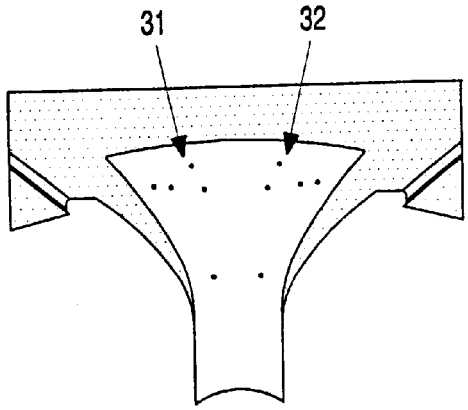
FIGS. 3A to 3C illustrate the deflection unit and the method in accordance with the invention.
Figure 3B:
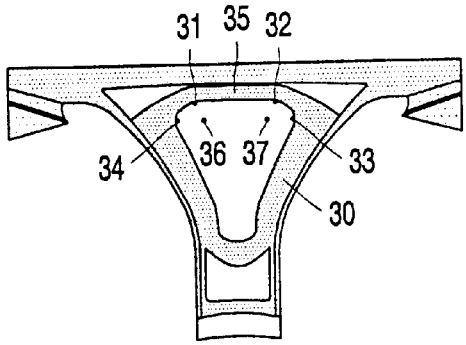
Figure 3C:
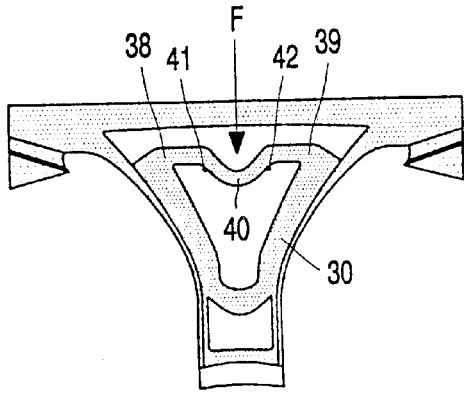

FIGS. 3A to 3C illustrate a method in accordance with the invention.

FIG. 3A shows the position of most of the winding pins, including two auxiliary pins 31 and 32. FIG. 2B shows the position of four winding pins, two corners pins 33 and 34 and two auxiliary pins 31 and 32. After winding the coil, a part 35 extends between the two auxiliary pins 31 and 32. Two additional auxiliary pins 36 and 37 (which did not play a part during the winding process, although then may have been present during the winding process) are provided. Pins 31 and 32 are subsequently removed and the upper part of the coil is pressed against the pins 36, 37, this pressing being schematically represented by arrow F. The resulting coil is illustrated in FIG. 4. By heating the coil, this shape is there after fixed. It comprises a concave part 40 having corners 41, 42 through which a line 43 is drawn, and two adjacent portions 38, 39. The angles $\alpha$ and $\beta$ are also indicated $\alpha>\beta$. In this case, $\beta=0$, which means that the portions 38 and 39 at either side of the corners 41, 42 of the concave part 40 run parallel.

The concave part 40 is introduced into the coil design to modify the field generated by the deflection coil. A typical modification is the introduction of a six-pole component in a particular part of the deflection field. However, each modification in the deflection field may result in itself in errors, for instance, the introduction of unwanted ten-pole components in the deflection field. The greater freedom the designer has to introduce modifications, the better such problems can be avoided. The known method only allows for concave parts to be made in the coil design if and where $\alpha<\beta$. Thus, for instance, concave parts cannot be made in straight, i.e. linear sections of the coil. This severely limits the positions where concave parts can be made and/or limits the concave shape of the concave part. The invention removes these limits since $\alpha>\beta$, introducing new opportunities and positions for introducing concave parts in the coil design and thus for modification of the coil design to correct errors.

The angle $\beta$ is preferably less than 10°, most preferably approximately 0°. The parts of the coils at either side of the corners 41, 42 are then (almost) in one line parallel to line 43. The concave part is then made in a straight section of the coil. Such a section generates a simple, well-defined deflection field. Such an embodiment of the invention allows a well-defined (in length and angle $\alpha$) concave part to be introduced into such a straight section without changing the rest of said part. In embodiments, $\beta$ may be smaller than 0, i.e. the combination of portions 38, 39 and part 40 then has an overall concave shape, and part 40 forms a concave part within a large concave part composed of portions 38, 39 and part 40 combined as illustrated in FIG. 5.

The angle $\alpha$ is preferably more than 20°. At such angles, the concave part is very pronounced, offering a relatively large modulation of the deflection field.

The invention is particularly important for embodiments in which the concave part (40) is provided at the front end (8,9,16,17) of a deflection coil. Modifications in the deflection field generally have the largest effect when the concave part is provided in the front end of a deflection coil. This being the case, it also means that the risk of one correction in the deflection field necessitating a further correction is also greatest when the concave part is provided at the front end, increasing the importance of being able to introduce modifications in the field with fewer restrictions of the design than in the known device and method.

In the examples given, two pins 36 and 37 are provided. Although this is a preferred embodiment due to its relative simplicity, the invention is not limited to application of only two additional auxiliary pins within the winding window. For more complex designs, four or more additional auxiliary pins could be used.

In summary, the invention can be described as follows. A deflection unit (4) comprises a saddle-shaped deflection coil (30). The deflection coil comprises at either the front or rear end a concave part (40) having a left and a right corner (41, 42) which define a line (43). The concave part (40) is flanked at either side by adjacent portions (38, 39). It holds that:

$$\alpha>\beta$$

where $\alpha$ is an angle between a line (43) through the two corners (40, 41) of the concave part (40) and inner windings of the concave part (40) and $\beta$ is an angle between said line (43) and the inner windings at the outer side of a corner (41, 42).

It will be clear that the invention is not limited to the embodiments shown by way of example in the Figures but that many variations are possible within the framework of the invention. In the claims, any reference signs placed between parentheses shall not be construed as limiting the claim. The verb "comprise" or its conjugations do not exclude the presence of elements or steps other than those stated in a claim. The article "a" or "an" preceding an element does not exclude the presence of a plurality of such elements. In a device claim enumerating several means, several of these means can be embodied by one and the same item of hardware. The mere fact that certain measures are recited in mutually different dependent claims does not indicate that a combination of these measures cannot be used to advantage.

What is claimed is:

1. A deflection unit (4) having at least one saddle-shaped coil (6, 7, 15, 15') having coil portions, and winding windows (19, 22), the coil portions comprising a front end portion (8,9, 16,17) and a rear end portion (11, 12), at least one of the end portions having a part (18, 28, 40) which has a concave shape between two corners (20, 21, 41, 42), characterized in that the following relation holds for the part (18, 28, 40) having a concave shape:

$$\alpha > \beta$$

where $\alpha$ is an angle between a line (43) through the two corners (40, 41) of the concave part (40) and inner windings of the concave part (40), and $\beta$ is an angle between said line (43) and the inner windings at the outer side of a corner (41, 42).

2. A deflection unit as claimed in claim 1, characterized in that $\beta$ is smaller than 10°.

3. A deflection unit as claimed in claim 2, characterized in that $\beta$ is approximately 0°.

4. A deflection unit as claimed in claim 1, characterized in that $\alpha$ is more than 20°.

5. A deflection unit as claimed in claim 1, characterized in that the front end portion comprises the part which has a concave shape.

6. A deflection coil for a deflection unit as claimed in claim 1.

* * * * *